US006263595B1

(12) United States Patent
Ake

(10) Patent No.: US 6,263,595 B1
(45) Date of Patent: Jul. 24, 2001

(54) LASER RECEIVER AND ANGLE SENSOR MOUNTED ON AN EXCAVATOR

(75) Inventor: DuWain K. Ake, Tipp City, OH (US)

(73) Assignee: Apache Technologies, Inc., Dayton, OH (US)

( * ) Notice: Subject to any disclaimer, the term of this patent is extended or adjusted under 35 U.S.C. 154(b) by 0 days.

(21) Appl. No.: 09/299,397

(22) Filed: Apr. 26, 1999

(51) Int. Cl.[7] ..... G05D 1/02

(52) U.S. Cl. ..... 37/348; 356/141.1; 356/141.3; 356/622; 356/72; 414/698

(58) Field of Search ..... 37/348, 382; 172/2, 172/4, 4.5; 701/50; 356/140, 141.1, 141.3, 141.5, 72, 622; 414/698, 699

(56) References Cited

U.S. PATENT DOCUMENTS

| | | |
|---|---|---|
| 3,017,046 | 1/1962 | Runci et al. . |
| 3,708,232 | 1/1973 | Walsh . |
| 3,727,332 | 4/1973 | Zimmer . |
| 3,813,171 | 5/1974 | Teach et al. . |
| 3,887,012 | 6/1975 | Scholl et al. . |
| 3,900,073 | 8/1975 | Crum . |

(List continued on next page.)

FOREIGN PATENT DOCUMENTS 2 101 077 1/1983 (GB) .

OTHER PUBLICATIONS

Topcon, "Excavator Touch Series 5, Automatic Slope & Depth Control," 1995, Topcon Laser Systems, Inc.

"360 degree Machine Guidance" and "Depthmaster" sales literature, by Laser Alignment, Inc. (exact date unknown, but known to be before Jun. 12, 1989).

"Laserplane Grade–Eye" sales literature, by Spectra–Physics (Oct. 8, 1988).

*Primary Examiner*—Victor Batson
(74) *Attorney, Agent, or Firm*—Davidson & Gribbell, LLP

(57) ABSTRACT

An improved level indicating system is provided for use with excavating equipment based upon a family of laser light receivers. In a first embodiment, a laser receiver with a single "long" photocell is mounted directly on the dipperstick of an excavator in a position that is designed to intercept pulses of laser light being emitted by a rotating laser light transmitter, and an angle-sensing sensor is also mounted to the dipperstick. In a second embodiment, a laser receiver with two parallel "long" photocells is mounted directly on the dipperstick, in which the pair of photocells are of sufficient precision to determine the angle of the dipperstick. In a third embodiment, a laser receiver with two parallel photocells is mounted directly on the dipperstick on a "servo mast" that can be re-positioned along the length of the dipperstick. The movable photocells thus can be shorter in length than the "long" photocells used in the second embodiment. In a fourth embodiment, a laser receiver with two or more parallel photocells is mounted on an "electric mast" which can have its elevation changed. Rotation sensors are mounted to the pivot joints between the platform and boom, the boom and dipperstick, and the dipperstick and bucket, so as to provide a complete solution in detecting the digging level with respect to the laser plane of light.

27 Claims, 6 Drawing Sheets

U.S. PATENT DOCUMENTS

| | | | | |
|---|---|---|---|---|
| 3,997,071 | | 12/1976 | Teach . | |
| 4,034,490 | | 7/1977 | Teach . | |
| 4,050,171 | | 9/1977 | Teach . | |
| 4,129,224 | | 12/1978 | Teach . | |
| 4,162,708 | | 7/1979 | Johnson . | |
| 4,231,700 | | 11/1980 | Studebaker . | |
| 4,273,196 | | 6/1981 | Etsusaki et al. . | |
| 4,393,606 | | 7/1983 | Warnecke . | |
| 4,413,684 | | 11/1983 | Duncklee . | |
| 4,491,927 | | 1/1985 | Bachmann et al. . | |
| 4,535,699 | | 8/1985 | Buhler . | |
| 4,604,025 | | 8/1986 | Hammoud . | |
| 4,676,634 | | 6/1987 | Petersen . | |
| 4,726,682 | | 2/1988 | Harms et al. . | |
| 4,829,418 | * | 5/1989 | Nielsen et al. | 172/4.5 X |
| 4,884,939 | | 12/1989 | Nielsen . | |
| 4,907,874 | | 3/1990 | Ake . | |
| 4,912,643 | * | 3/1990 | Beirxe | 172/4.5 X |
| 4,976,538 | | 12/1990 | Ake . | |
| 5,174,385 | * | 12/1992 | Shinbo et al. | 172/4.5 |
| 5,343,033 | | 8/1994 | Cain . | |
| 5,471,049 | | 11/1995 | Cain . | |
| 5,486,690 | | 1/1996 | Ake . | |
| 5,528,498 | * | 6/1996 | Scholl | 364/424.07 |
| 5,682,311 | * | 10/1997 | Clark | 364/424.07 |
| 5,848,485 | * | 12/1998 | Anderson et al. | 37/348 |
| 5,854,988 | * | 12/1998 | Davidson et al. | 701/50 |
| 5,925,085 | * | 7/1999 | Kleimenhagen et al. | 701/50 |
| 5,950,141 | * | 9/1999 | Yamamoto et al. | 702/41 |
| 5,960,378 | * | 9/1999 | Watanabe et al. | 702/150 |

* cited by examiner

LASER RECEIVER AND ANGLE SENSOR MOUNTED ON AN EXCAVATOR

TECHNICAL FIELD

The present invention relates generally to laser light receiving equipment and is particularly directed to a laser receiver mounted on an excavator. The invention is specifically disclosed as a laser receiver that is used to detect a rotating beam of laser light, in which angle-sensing devices and the position of the laser light striking the laser receiver provide control information to the operator of the excavator.

BACKGROUND OF THE INVENTION

One of the most common earth moving machines used in the general construction industry is the mechanized shovel. Such digging machines are generally available in two varieties which are known as the "excavator" and the "backhoe," although a "trencher" (sometimes called a DITCH-WITCH) can also be placed in this category. An excavator is generally the largest of these machine types. A simplified drawing of a machine of this type is shown on FIG. 1.

An excavator, generally designated by the reference numeral 10, usually comprises a tracked machine with a pivot between its lower tracked carriage 18 and its cab assembly 20, which provides for side-to-side motion during operation. The digging apparatus generally consists of two extending members called arms, and a bucket 16. The first arm 12 is commonly called the "boom" and the second arm 14 is commonly called the "dipperstick."

A backhoe is generally smaller than an excavator but shares several similarities. A backhoe is generally a rubber tired machine which has its shovel portion on one end of the machine and another bucket on the other end. This second bucket apparatus is similar to a front-loader and is commonly used for moving material instead of digging. Like the excavator, the backhoe has a shovel implement which typically consists of a boom, dipperstick, and a bucket. This type of machine typically has a pivot between the cab portion and the boom arm to provide side-to-side motion while digging.

In operation, an operator of either a backhoe or excavator (hereinafter referred to generally as an "excavator") typically must dig to a particular elevation. If the operator digs too shallow then he must come back and rework the area; if he digs too deep then excessive fill material must be used. In order to determine the elevation in conventional systems, a second person is used to measure elevations for the machine operator. This person would either be using a laser system or an automatic level to determine the current elevation. If an automatic level is used then a third person is required to operate the level. This is further complicated if the digging depth is desired to be sloping, and not dug to a consistent (i.e., level) elevation. In this case, someone must keep track of the distance moved and periodically either add or subtract a certain elevation based on the distance and the desired slope.

Since some of the conventional digging systems in the prior art are so cumbersome and labor intensive, as described above, it would be very desirable to have available a digging system where the excavator operator can check his own digging elevation without the need for another person's help, and without stopping and getting out of the cab. Therefore, there is a need for an elevation indication system for excavators which is low cost, easy to install, is based on an absolute elevation reference, and if possible, provides elevation information while the operator is actually digging, rather than requiring him to stop to take a reading.

One major improvement in excavator systems is the use of a laser receiver mounted on the dipperstick of the excavator, in which the laser receiver intercepts the pulsed plane of laser light that is emitted by a rotating laser light source. Naturally, the more accurate the laser receiver, the greater the possible accuracy of the operation of the excavator. Therefore, a key element of many excavator systems is the ability of the laser receiver to operate with acceptable accuracy and in varying lighting conditions. To accomplish this function, a laser receiver, generally designated by the reference numeral 30, is mounted on the dipperstick 14 of the machine 10 to accurately measure the position of the laser beam striking the receiver. The laser receiver includes a photocell assembly that is sensitive to the wavelength of light that is transmitted by a rotating laser light transmitter.

There are several products available on the market today which attempt to solve the problem of digging to a given depth, however, with varying degrees of success. One such product is called the DEPTHMASTER™, and is manufactured by Laser Alignment of Grand Rapids, Mich. The DEPTHMASTER is described in U.S. Pat. No. 4,884,939, invented by Nielsen. In this product, a laser receiving sensor is integrated with an inclinometer and is mounted on the dipperstick of a digging machine (e.g., an excavator). The inclinometer consists of two mercury switches configured to indicate when the angle of the stick is vertical (with respect to gravity). In operation, the combination integrated sensor informs the excavator's operator of the relative elevation of the dipperstick and whether the dipperstick is plumb. Only when the dipperstick is plumb can an accurate elevation reading be taken. The disadvantages of this approach are that the operator must stop digging to take a reading and that a reading can only be made while the dipperstick is in a plumb position. This greatly limits the practical usefulness of such the DEPTHMASTER system.

Another system for controlling excavators is known as an EXCAVATOR TOUCH SERIES 5™, manufactured by Topcon Laser Systems of Pleasanton, Calif. The EXCAVATOR TOUCH SERIES 5 is described in U.S. Pat. No. 4,129,224, invented by Teach. This Topcon system comprises a precision angle measuring device mounted on each of the three moving joints on the excavator, and a level sensing device mounted on the cab of the machine. In operation, the Topcon system is programmed with the dimensions of each of the machine arms such that, by using the sensor inputs and simple trigonometry, the elevation of the bucket teeth can be calculated. This calculation can be done both while the machine is stationary (static mode) as well as while in motion (dynamic mode). In practice, this is a very expensive system and is very difficult to install. As such, its market is typically limited to the very high end excavators and customers who will use the system for the majority of the machine's physical operations. Furthermore, this Topcon system is purely based on relative elevation and has no absolute elevation reference. This means that each time the machine is used, or if it is moved, a new elevation reference must be established. This is time consuming and allows for more possibility of errors during the necessary repeated setups. If an absolute elevation reference is desired, then an (additional) accessory laser system must be added. Finally, both the laser transmitter and the cab's laser receiver must be set to precisely the same angle; otherwise the resultant ditch will have a staircase effect (instead a smooth slope).

Other excavator systems are available from several manufacturers based on U.S. Pat. No. 4,491,927 (by Bachmann) in which an inclinometer is mounted on each of the boom, dipperstick, and bucket. From the physical dimensions of the Bachmann excavator and the angle of each member with respect to horizontal, trigonometry can be used to find the elevation of the bucket teeth. However, this Bachmann system also has a characteristic in which it provides relative elevation indications only, similar to the Topcon system. Furthermore, due to problems involving damping of the inclinometers, it may be impossible to provide a Bachmann system with the required accuracy while operating in a dynamic mode.

Therefore, there is a need for an elevation indication system for excavators which is low cost, easy to install, and is based on an absolute elevation reference. In addition, there is a need for an excavator indication system that provides elevation information while the operator is actually digging in the dynamic mode, rather than requiring him stop to take a reading.

Furthermore, a system that also uses the laser plane as an angular reference is inherently superior to the currently available conventional systems that use a machine mounted level reference device where the motion of the machine can cause significant errors in the sensing mechanism. In the conventional systems, when a sloped ditch is being dug (as is often the case) and a laser is used for the elevation reference and a gravity based device is used for an angular reference, it is necessary to set both the laser and the digging control system to the desired ditch slope in order to avoid a ditch bottom which has a "stair step" profile. This complicates system setup and allows for additional setup errors.

SUMMARY OF THE INVENTION

Accordingly, it is a primary advantage of the present invention to provide a laser light receiver and angle-sensing system that is capable of determining the digging level of an excavator's bucket to a greater degree of accuracy than has been previously available, while using the laser light plane as an angular reference.

It is another advantage of the present invention to provide a relatively simple sensing system that uses a single laser receiver and a single angle sensor system that is capable of determining the digging level of an excavator's bucket in a static measuring mode, while using the laser light plane as an angular reference.

It is a further advantage of the present invention to provide a sensing system that uses dual laser receivers in a system that is capable of determining the digging level of an excavator's bucket in a dynamic measuring mode, while using the laser light plane as an angular reference.

It is a yet further advantage of the present invention to provide a sensing system that uses dual laser receivers in a system that is capable of determining the digging level of an excavator's bucket in a dynamic measuring mode, and in which the digging angle can be sloped without a staircase effect, while using the laser light plane as an angular reference.

It is still a further advantage of the present invention to provide a sensing system that uses two or more laser receivers and one or more angle sensors in a system that is capable of determining the digging level of an excavator's bucket in a dynamic measuring mode, while using the laser light plane as an angular reference.

It is yet another advantage of the present invention to provide a sensing system that uses two or more laser receivers and one or more angle sensors in a system that is capable of determining the digging level of an excavator's bucket in a dynamic measuring mode, and in which the digging angle can be sloped without a staircase effect, while using the laser light plane as an angular reference.

Additional advantages and other novel features of the invention will be set forth in part in the description that follows and in part will become apparent to those skilled in the art upon examination of the following or may be learned with the practice of the invention.

To achieve the foregoing and other advantages, and in accordance with one aspect of the present invention, an improved level indicating system is provided for use with excavating equipment in which a family of laser light receivers, and in some cases angle sensors, are used to visually and sometimes audibly inform an excavator operator if the bucket is on-grade, or above or below grade. Four different embodiments are disclosed, and in each case the level indicating system is completely laser based, which provides a consistent elevation reference that is highly accurate. There is no need to re-establish the reference elevation when the excavating machine is moved during the course of digging.

In a first embodiment, a laser receiver with a single "long" photocell is mounted directly on the dipperstick of an excavator in a position that is designed to intercept pulses of laser light being emitted by a rotating laser light transmitter. An angle-measuring sensor is also mounted to the dipperstick so as to provide the necessary information to calculate the vertical distance between the reference level of the laser plane of light and the actual digging level. The elevation must be measured in a "static" mode of operation with this particular embodiment.

In a second embodiment, a laser receiver with two parallel "long" photocells is mounted directly on the dipperstick of an excavator in a position that is designed to intercept pulses of laser light being emitted by a rotating laser light transmitter. The photocells are of sufficient precision to determine the angle of the dipperstick with respect to the vertical from the position each photocell detects the plane of laser light impacting on the photocells. With this information, the vertical distance between the reference level of the laser plane of light and the actual digging level can be determined, and the on-grade digging level can be indicated while operating in a dynamic mode.

In a third embodiment, a laser receiver with two parallel photocells is mounted directly on the dipperstick of an excavator in a position that can be changed along the length of the dipperstick so as to ensure that the photocells will intercept pulses of laser light being emitted by a rotating laser light transmitter. The photocells thus can be shorter in length than the "long" photocells used in the second embodiment, while increasing the portions of the dipperstick that can be covered by the photocells. The photocells are of sufficient precision to determine the angle of the dipperstick with respect to the vertical from the position each photocell detects the plane of laser light impacting on the photocells. With this information, the vertical distance between the reference level of the laser plane of light and the actual digging level can be determined, and the on-grade digging level can be indicated while operating in a dynamic mode.

In a fourth embodiment, a laser receiver with two or more parallel photocells is mounted to an electric mast which can have its elevation changed so as to ensure that the photocells will intercept pulses of laser light being emitted by a rotating laser light transmitter. The electric mast is in turn mounted to the chassis or platform of the excavator. Rotation sensors are mounted to the pivot joints between the platform and boom, the boom and dipperstick, and the dipperstick and bucket, so as to provide a complete solution in detecting the digging level with respect to the laser plane of light. With this information, the vertical distance between the reference level of the laser plane of light and the actual digging level can be determined, and the on-grade digging level can be indicated while operating in a dynamic mode.

Still other advantages of the present invention will become apparent to those skilled in this art from the following description and drawings wherein there is described and shown a preferred embodiment of this invention in one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description and claims serve to explain the principles of the invention. In the drawings:

DETAILED DESCRIPTION OF THE PREFERRED EMBODIMENT

Reference will now be made in detail to the present preferred embodiment of the invention, an example of which is illustrated in the accompanying drawings, wherein like numerals indicate the same elements throughout the views.

Figure 1:
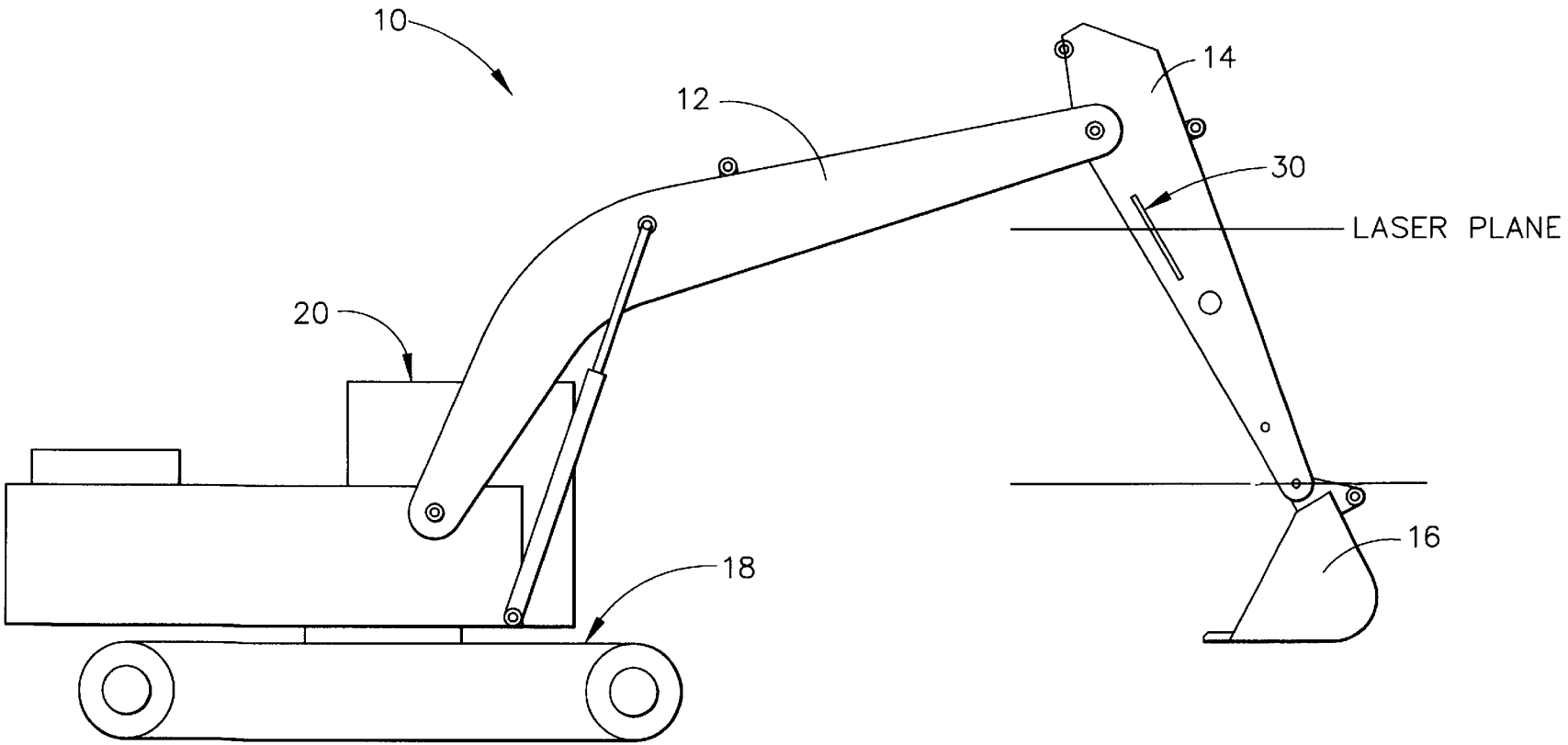
FIG. 1 (PRIOR ART)
FIG. 1 is an elevational view of an excavator known in the prior art that has a laser receiver mounted to its dipper stick, such that the laser receiver intercepts a plane of laser light being emitted by a rotating laser transmitter.
Figure 2:
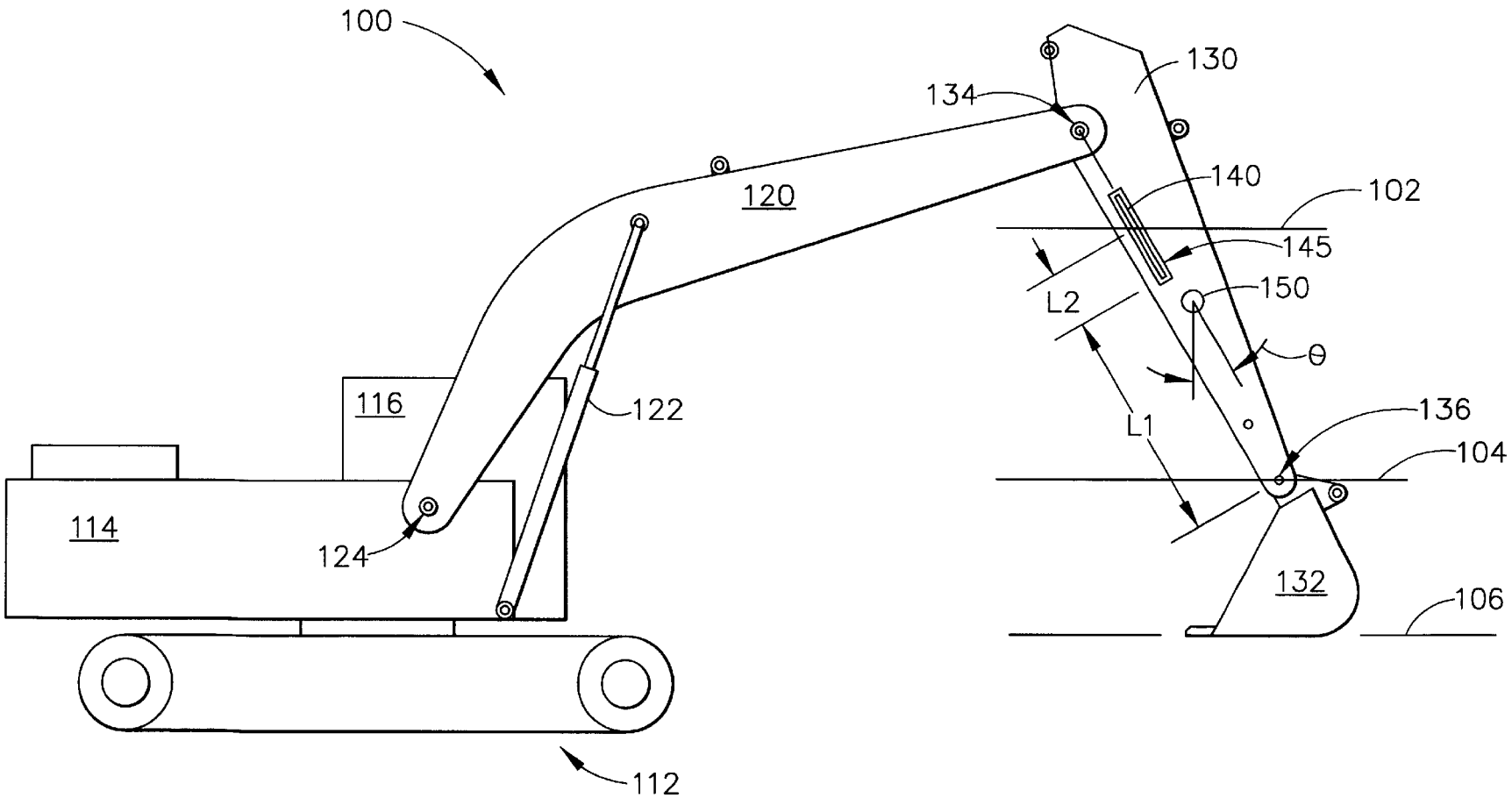
FIG. 2 is an elevational view of a first preferred embodiment of an excavator constructed according to the principles of the present invention, which is used to measure elevation in a static mode of operation, in which the laser receiver is mounted on the dipperstick with an angle sensor.

Referring now to the drawings, FIG. 2 shows an improved excavator apparatus constructed according to a first embodiment of the present invention that is designed to measure elevation only in a "static" mode, in which the operator would momentarily stop digging, curl the bucket to a known position, and move the boom and dipper to check the elevation of various portions of the digging area. On FIG. 2, the excavator is generally designated by the reference numeral 100, which has a pivotable main chassis or body 114, a (typically) fully tracked mechanical drive 112, and an operator cab assembly 116. The digging apparatus generally consists of a boom 120, a dipperstick 130, and a bucket 132. To maintain the proper digging level, the bucket must be maintained in its known position.

The boom 120 is pivotable with respect to the chassis 114 about a pivot point 124, and the relative position of the boom 120 is controlled by a hydraulic piston 122. The dipperstick 130 is pivotable with respect to the boom 120 about a pivot point 134, which typically also is controlled by a hydraulic piston (not shown for clarity of these views). Finally, the bucket is pivotable with respect to the dipperstick about a pivot point 136, which typically also is controlled by a hydraulic piston (also not shown for clarity of these views).

The excavator 100 is provided with a "long" precision laser receiver assembly 145 having a photocell 140, which is mounted directly to the dipperstick 130, and which, therefore, changes angle with respect to the vertical (i.e., plumb line) as the dipperstick itself is pivotally moved with respect to the boom 120. The angle between the laser receiver's longitudinal centerline and the vertical plumb line is designated as "θ".

Two important planes are depicted on FIG. 2: the first plane, designated by the reference numeral 102, is that formed by the rotating laser light emitted by a rotating laser light transmitter (not shown); the second plane, designated by the reference numeral 104, is that formed by the movement of the pivot point 136 when the bucket 132 digs at a desired depth. The linear distance, along the angled line of the laser receiver's centerline, between the bottom edge of laser receiver photocell 140 and the point where laser receiver's photocell 140 is impacted by the laser light of plane 102 is designated as "L2". The linear distance, along the angled line of the laser receiver's centerline, between the bottom edge of laser receiver photocell 140 and the pivot point 136 is designated as "L1 ". Given these variables, the basic system equation is given as follows:

$$\text{Elevation}=(L1+L2)\cos\theta \qquad \text{EQUATION \#1:}$$

The operator interface preferably consists of a simple grade display in the cab indicating whether the elevation is high, low, or on-grade. It preferably also provides an indication of the distance off-grade by having a growing arrow style display for high and low. Such grade displays are known in the art, and are available from Apache Technologies, Inc. of Dayton, Ohio.

To accomplish the required functions, the "long" laser receiver assembly 145 mounted on the dipperstick must be able to accurately measure the position of the laser beam on the receiver's photocell. In addition, an inclination sensor 150 is mounted to the dipperstick. This inclination sensor (or "inclinometer") preferably is a Schaevitz-type or similar sensor, and the inclination sensor could be mounted in the housing of the laser receiver assembly 145. Schaevitz manufactures an inclination sensor with an optional analog output voltage that is proportional to the angle. Other suitable sensors are also available, including a vial-type sensor (see FIG. 6 at 460) that contains a conductive fluid, which would require a bridge interface (see FIG. 6 at 462) and an AC voltage supply for the bridge. When tilted, the fluid changes conductivity of certain internal conductors, thereby causing the output voltage to vary.

The inclination sensor 150 preferably provides an accurate electrical output signal that is responsive to the angular orientation of dipperstick 130. More specifically, the output should be responsive to the difference in the angle θ and a gravity reference, which means that inclination sensor 150 needs to be sensitive to the difference between a vertical (or plumb) line and the actual angular position of dipperstick 130.

During installation, the laser receiver mounted at a known distance above the bucket-dipper joint (i.e., L2, along the laser receiver's centerline). In operation, the control system measures the position of the laser beam impacting on laser receiver photocell 140 (at plane 102) and the angle θ of the dipper, then uses Equation #1 (a simple trigonometric equation) to determine the elevation (i.e., plane 104) of the bucket pin 136 below the laser reference plane 102. This elevation is compared to the reference elevation to determine if the current elevation is above or below the desired elevation.

The preferred receiver electronics are described in U.S. Pat. No. 5,343,033 (by Cain), which is commonly owned by Apache Technologies, Incorporated of Dayton Ohio, and is incorporated by reference herein in its entirety. A related patent is U.S. Pat. No. 5,471,049. The preferred laser receiver photocell is described in U.S. patent application Ser. No. 09/192,770, filed on Nov. 16, 1998, which is commonly owned by Apache Technologies, Incorporated of Dayton Ohio, and is incorporated by reference herein in its entirety.

One potential error source in this system is cross-axis tilt of the excavator machine. If the machine is set up on a surface which is not essentially level in a side-to-side orientation as seen from the cab of the machine, significant elevation errors can occur. To compensate for this error, a cross-axis vial or a single multi-axis vial optionally can be mounted with an electrical output connected into the control system. In this way, the cross-axis tilt of the machine can be measured and compensated for.

A fundamental limitation of this concept (besides being purely static) is the range of digging depths and angles that can be achieved. As either of these factors increases, the length of the receiver must become longer. A laser receiver photocell 140 of about three feet (3'=91.4 cm) length may be a practical maximum limit, since mechanical concerns begin to arise with longer lengths, since the receiver is to operate in a rather harsh environment, and of course the cost increases with length. Another limitation is that if a sloped ditch is being dug, then a stepped ditch bottom would likely result.

A Table #1 is provided below and shows the relationship of digging depth and dipper angle for a three foot (3'=91.4 cm) long receiver photocell. Digging depth is defined as the distance of the bucket joint below the laser plane (i.e., a line as depicted by the reference number 106 on FIG. 2). This Table #1 represents how deep the ditch can be for the control system to properly operate.

TABLE 1

| DIPPER ANGLE (Degrees) | DIGGING DEPTH (Feet) |
|---|---|
| 30 | 14.71 |
| 31 | 13.65 |

TABLE 1-continued

| DIPPER ANGLE (Degrees) | DIGGING DEPTH (Feet) |
|---|---|
| 32 | 12.68 |
| 33 | 11.80 |
| 34 | 11.00 |
| 35 | 10.27 |
| 36 | 9.59 |
| 37 | 8.97 |
| 38 | 8.40 |
| 39 | 7.87 |
| 40 | 7.38 |
| 41 | 6.93 |
| 42 | 6.51 |
| 43 | 6.11 |
| 44 | 5.75 |
| 45 | 5.41 |

Figure 3:
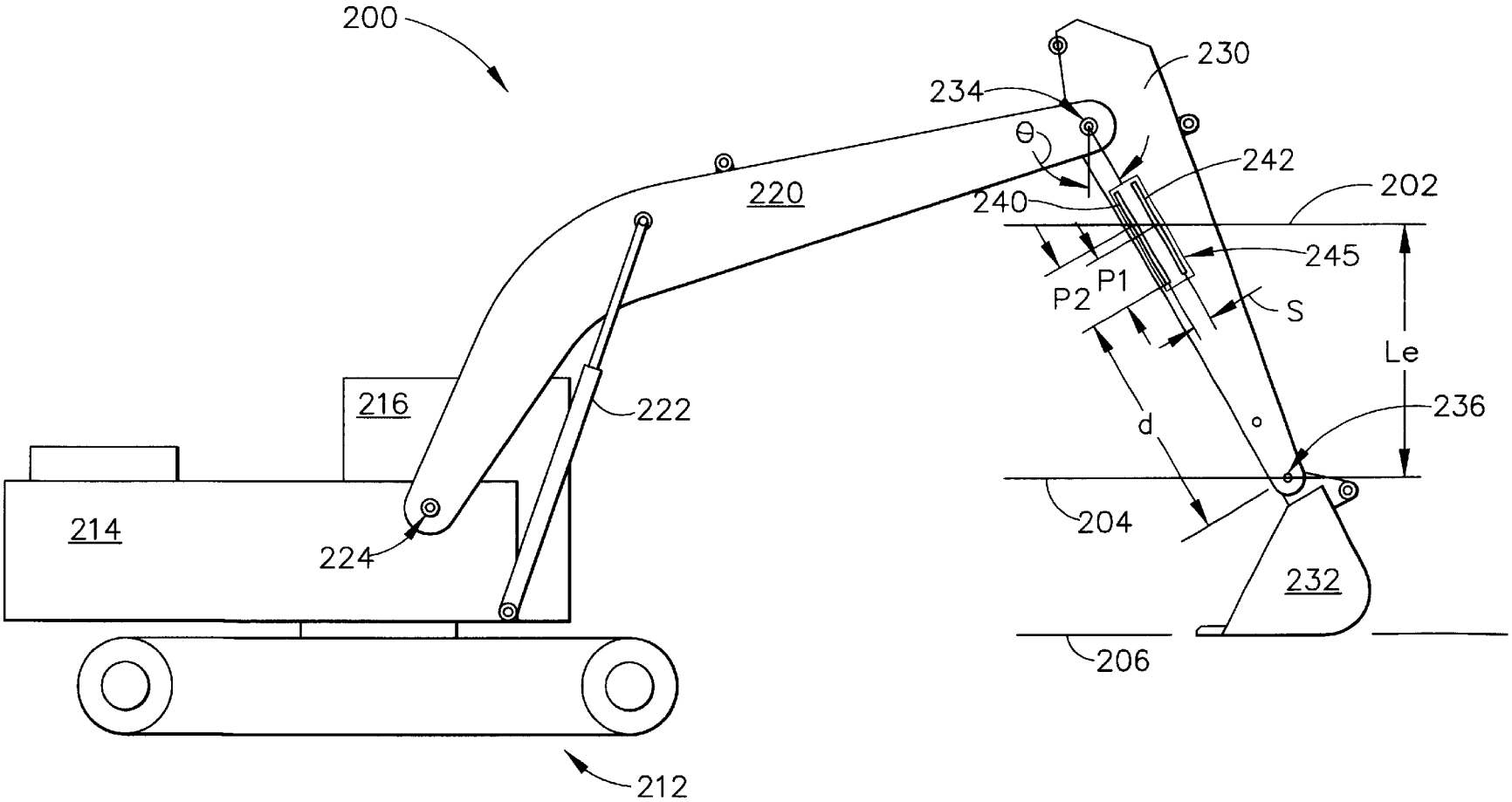
FIG. 3 is an elevational view of a second preferred embodiment of an excavator constructed according to the principles of the present invention, which is used to measure elevation in a dynamic mode of operation, in which the laser receiver is mounted on the dipperstick and which contains two photocells capable of detecting the angle of the dipperstick.

Referring now to FIG. 3, an improved excavator apparatus constructed according to a second embodiment of the present invention is depicted which provides the ability to indicate elevation in a "dynamic" mode of operation. On FIG. 3, the excavator is generally designated by the reference numeral 200, which has a pivotable main chassis or body 214, a (typically) fully tracked mechanical drive 212, and an operator cab assembly 216. The digging apparatus generally consists of a boom 220, a dipperstick 230, and a bucket 232.

The boom 220 is pivotable with respect to the chassis 214 about a pivot point 224, and the relative position of the boom 220 is controlled by a hydraulic piston 222. dipperstick 230 is pivotable with respect to the boom 220 about a pivot point 234, which typically also is controlled by a hydraulic piston (not shown for clarity of these views). Finally, the bucket is pivotable with respect to the dipperstick about a pivot point 236, which typically also is controlled by a hydraulic piston (also not shown for clarity of these views).

The excavator 200 is provided with a laser receiver assembly 245, having a first "long" precision laser receiver photocell 240 and a second "long" precision laser receiver photocell 242, which are mounted directly to the dipperstick 240, and which, therefore, change angles with respect to the vertical (i.e., plumb line) as the dipperstick itself is pivotally moved with respect to the boom 220. The receiver photocells 240 and 242 are preferably mounted parallel to each other and spaced apart by about six inches (6"=15.2 cm), which is indicated by the dimension "s" (for "spacing") on FIG. 3. The angle between the laser receiver's longitudinal centerline (i.e., the line between the two laser receiver photocells 240 and 242) and the vertical plumb line is designated as "θ". The laser receiver photocells 240 and 242 are preferably mounted into a common housing of the receiver assembly 245.

Two important planes are depicted on FIG. 3: the first plane, designated by the reference numeral 202, is that formed by the rotating laser light emitted by a rotating laser light transmitter (not shown); the second plane, designated by the reference numeral 204, is that formed by the movement of the pivot point 236 when the bucket 232 digs at a desired depth.

The linear distance, along the angled line of the laser receiver's centerline, between the bottom edge of laser receiver photocell 240 and the point where photocell 240 is impacted by the laser light of plane 202 is designated as "P2". The linear distance, along the angled line of the laser receiver's centerline, between the bottom edge of laser receiver photocell 242 and the point where photocell 242 is impacted by the laser light of plane 202 is designated as "P1". The linear distance, along the angled line of the laser receiver's centerline, between the bottom edge of photocell 240 (and photocell 242 at this angle) and the pivot point 236 is designated as "d". The linear distance, along a vertical line, between the point where the centerline between laser receiver photocells 240 and 242 are impacted by the laser light of plane 202 and the plane 204 of the bucket joint 236 is designated as "Le".

Given these variables, the basic system equation is given as follows:

EQUATION #2:

$$Le\left(d+\left(\frac{P1+P2}{2}\right)\right)\times\cos\left(\tan^{-1}\left(\frac{P2-P1}{s}\right)\right)$$

The intent of this configuration is to measure the position of the beam on each of the receiver's photocells (240 and 242) and thereby determine both elevation and angle of the dipperstick 230 at the same time. By measuring dipper angle θ with the plane of laser light 202 as a level reference, the angle θ can be determined while the machine arms 220 and 230 are still moving and thereby provide the ability to indicate elevation in a dynamic mode of operation.

The operator interface again preferably consists of a simple grade display in the cab indicating whether the elevation is high, low, or on-grade, along with a growing arrow style display for high and low. Such grade displays are known in the art, and are available from Apache Technologies, Inc. of Dayton, Ohio. In addition, an audible tone could be supplied to inform the operator of the current grade position without him looking away from the digging operation. No other user controls are required except for setup information.

During installation, the laser receiver assembly 245 is mounted at a known distance above the bucket-dipper joint (i.e., "d", along the laser receiver's centerline). In operation, the control system measures the position of the laser beam impacting on photocells 240 and 242 (at plane 202) to effectively determine the angle θ of the dipper, then uses Equation #2 to determine the elevation (i.e., plane 204) of the bucket pin 236 below the laser reference plane 202. This elevation is compared to the reference elevation to determine if the current elevation is above or below the desired elevation.

As with the Static System, a fundamental limitation of this concept is the range of digging depths and angles that can be achieved. As either of these factors increases, the length of the laser light receiving photocells must become longer. A Table #2 is provided below and shows the relationship of digging depth and dipper angle for laser light receiving photocells that are three feet (3'=91.4 cm) in length. Digging depth is defined as the distance of the bucket joint below the laser plane (i.e., a line as depicted by the reference number 206 on FIG. 3). This Table #2 represents how deep the ditch can be for the control system to properly operate.

TABLE 2

| DIPPER ANGLE (Degrees) | DIGGING DEPTH (Feet) |
|---|---|
| 30 | 12.84 |
| 31 | 11.84 |
| 32 | 10.94 |
| 33 | 10.11 |

TABLE 2-continued

| DIPPER ANGLE (Degrees) | DIGGING DEPTH (Feet) |
|---|---|
| 34 | 9.36 |
| 35 | 8.68 |
| 36 | 8.05 |
| 37 | 7.48 |
| 38 | 6.95 |
| 39 | 6.46 |
| 40 | 6.01 |
| 41 | 5.59 |
| 42 | 5.20 |
| 43 | 4.84 |
| 44 | 4.51 |
| 45 | 4.20 |

The preferred receiver electronics again are described in U.S. Pat. No. 5,343,033 (by Cain). The preferred laser receiver photocell is described in U.S. patent application Ser. No. 09/192,770, filed on Nov. 16, 1998.

One potential error source in this control system again is cross-axis tilt of the excavator machine. To compensate for this error, a cross-axis vial or a single multi-axis vial optionally can be mounted with an electrical output connected into the control system. In this way, the cross-axis tilt of the machine can be measured and compensated for. In addition, some type of bucket sensor could be added to provide a complete sensing solution. This bucket sensor could be an angle sensor similar to Topcon's system, or perhaps some sort of hydraulic flow sensor, should this technique later prove to be reliable.

Sensors that are able to directly measure the angle between the dipperstick and bucket include optical encoders and RVDT's. Such sensors must, of course, be rotational sensing devices, and an absolute optical encoder would work well so long as it is properly sealed from the construction site environment. The RVDT-type sensor uses a rotational variable differential transformer, and can be easily made to operate in "rough" environments. In addition, a linear-type optical encoder could be used.

Based on an error analysis of this configuration (without a bucket angle sensor), the distance between the two photocells 240 and 242 should be about 6" (15.2 cm). This separation would provide a desirable system accuracy of ±0.05' (15.2 mm) assuming a laser receiver positional accuracy of ±0.01" (0.25 mm). Since the level reference of the dynamic system of FIG. 3 is purely laser based, if a sloped ditch is being dug, there will be no stair-stepping of the ditch bottom.

Figure 4:
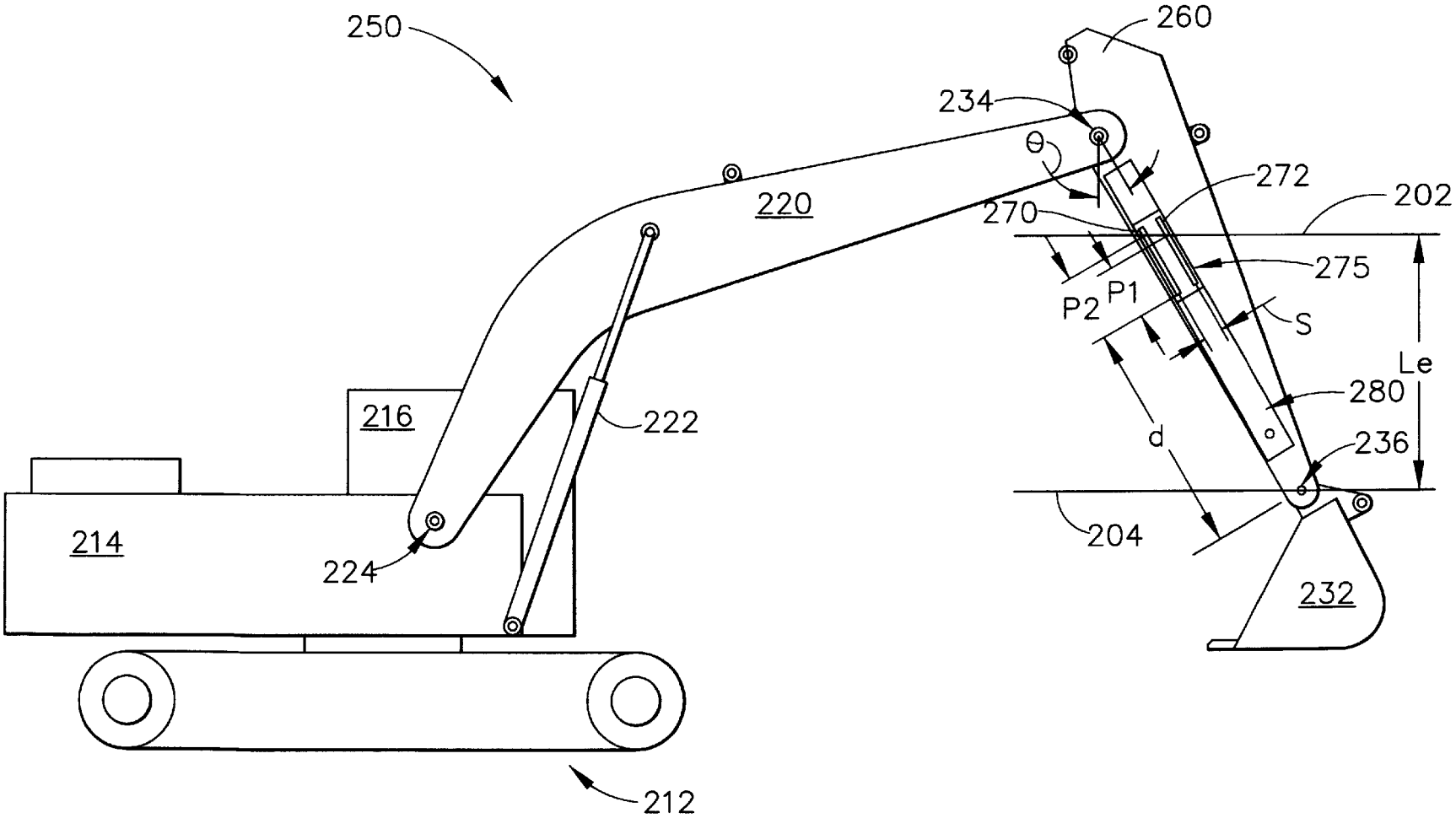
FIG. 4 is an elevational view of a third preferred embodiment of an excavator constructed according to the principles of the present invention, which is used to measure elevation in a dynamic mode of operation, in which the laser receiver is mounted on the dipperstick and which contains two photocells capable of detecting the angle of the dipperstick, moreover the laser receiver is movable along the dipperstick by a servo mast.

Referring now to FIG. 4, another improved excavator apparatus constructed according to a third embodiment of the present invention is depicted which provides the ability to indicate elevation in a "dynamic" mode of operation. This third embodiment, generally indicated by the reference numeral 250, is almost identical in construction to the second embodiment 200, described hereinabove. The major difference between the two embodiments is that a shorter receiver assembly 275 is mounted to the dipperstick 260 on a motorized mount called a "servo mast." This results in the possible use of two shorter laser receiver photocells at 270 and 272, in which the receiver assembly 275 is able to be re-positioned along a channel 280, which is co-linear with the angle θ along the centerline between the laser receiver photocells 270 and 272.

The function of the servo mast is to move the receiver assembly 275 up and down on the side of the dipperstick 260 to track the position of the laser plane 202 as that laser plane moves up or down with respect to the dipperstick 260 of excavator 250. Using this approach, a relatively "short" set of photocells can be provided on the receiver assembly 275 and the length of these photocells (i.e., photocells 270 and 272) would not have to grow with longer dipperstick length and wider digging angles. This servo mast (i.e., its channel 280 in combination with dipperstick 260) could be made quite long thereby providing a much greater range of digging depths and angles without the receiver length growing too large and costly. As an optional feature, the receiver assembly 275 could be made to extend beyond the pivot points 234 and 236 by relocating the photocells 270 and 272.

As in the second embodiment 200, the operator interface again preferably consists of a grade display in the cab indicating whether the elevation is high, low, or on-grade, along with a growing arrow style display for high and low. Such grade displays are known in the art, and are available from Apache Technologies, Inc. of Dayton, Ohio. In addition, an audible tone could be supplied to inform the operator of the current grade position without him looking away from the digging operation.

An on-grade setpoint switch preferably is also included in the operator control panel (not shown). To set up the excavating machine, the customer would set the laser transmitter to a fairly arbitrary elevation and the operator of excavator 250 would place the bucket 232 at the benchmark elevation (e.g., at plane 206). Then the operator would press the on-grade setpoint switch (not shown) to establish the on-grade elevation.

After set-up, the elevation of the bucket pin 236 with respect to the laser plane 202 is determined by Equation #2, however, with a summing factor (which could be positive or negative) that accounts for the position of the servo mast with respect to a neutral or "zero" position along the channel 280. (In other words, the distance "d" can vary, depending upon the position of the receiver assembly 275 along the channel 280.) Since the servo mast can change position along the dipperstick 260, the summing factor can dynamically vary as the laser receiver assembly 275 is re-positioned along channel 280, thus providing a "dynamic" measuring system.

Because the control system for excavator 250 does not have a fixed on-grade position (unlike the previously-described digging systems), but instead allows the operator to set the on-grade position, additional features are possible. Such features include producing a stepped digging profile (where desired).

Figure 5:
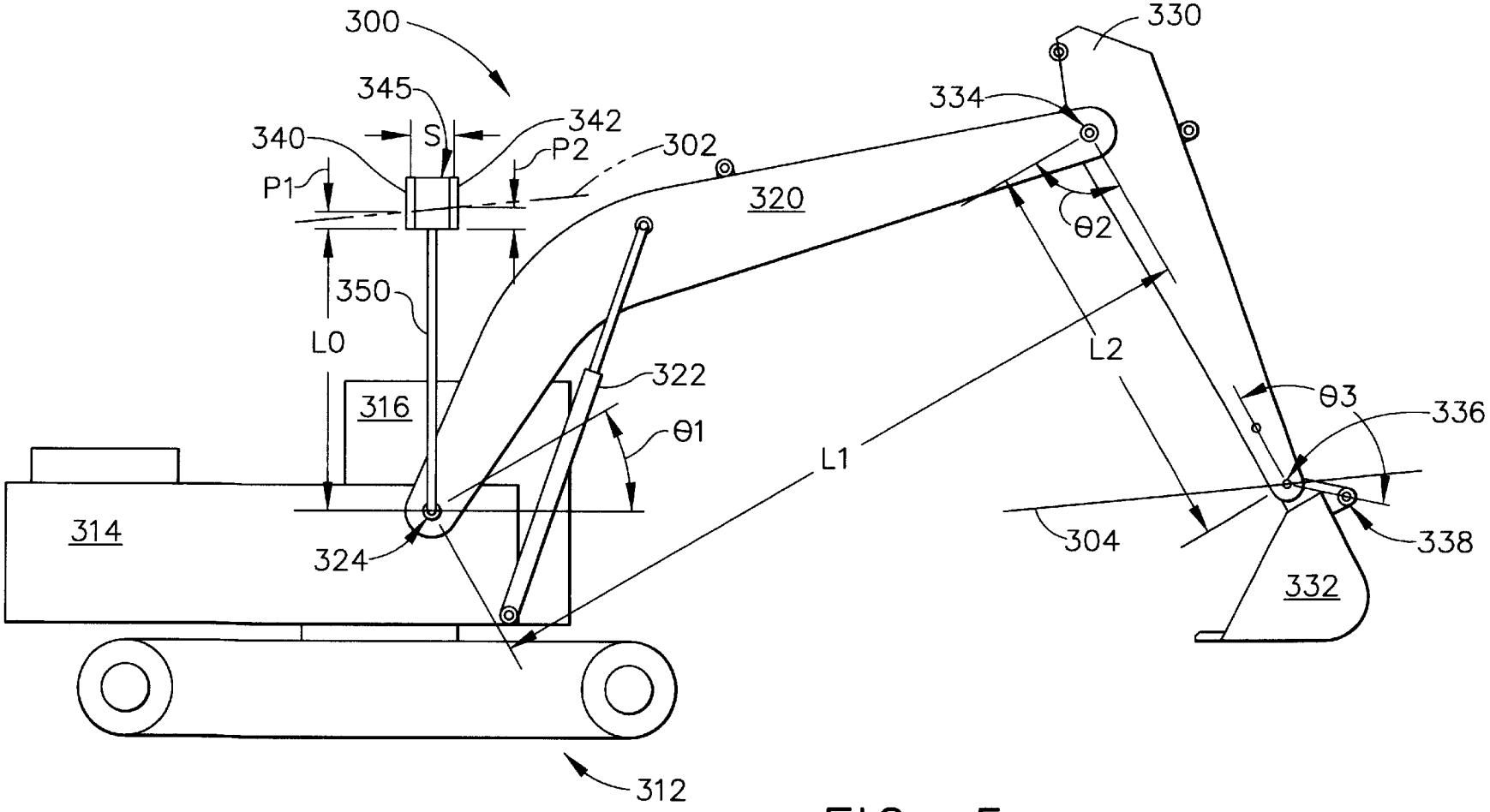
FIG. 5 is an elevational view of a third preferred embodiment of an excavator constructed according to the principles of the present invention, which is used to measure elevation in a dynamic mode of operation, in which the laser receiver is mounted on an electric mast, and angle sensors are mounted at the pivot joints of the excavator arms.

Referring now to FIG. 5, another improved excavator apparatus constructed according to a fourth embodiment of the present invention is depicted which also provides the ability to indicate elevation in a "dynamic" mode of operation. On FIG. 5, the excavator is generally designated by the reference numeral 300, which has a pivotable main chassis or body 314, a (typically) fully tracked mechanical drive 312, and an operator cab assembly 316. The digging apparatus generally consists of a boom 320, a dipperstick 330, and a bucket 332. On excavators working in tight quarters, it is possible for the boom 320 to be constructed in two articulated pieces (not shown on FIG. 5), which configuration is more popular in Europe.

The boom 320 is pivotable with respect to the chassis 314 about a pivot point 324, and the relative position of the boom 320 is controlled by a hydraulic piston 322. The dipperstick 330 is pivotable with respect to the boom 320 about a pivot point 334, which typically also is controlled by a hydraulic piston (not shown for clarity of these views). Finally, the bucket is pivotable with respect to the dipperstick about a pivot point 336, which typically also is controlled by a hydraulic piston (also not shown for clarity of these views).

The excavator 300 is provided with a laser receiver assembly 345, having a first precision laser receiver photocell 340 and a second precision laser receiver photocell 342, which are mounted to an "electric mast" 350, which in turn is mounted on the platform or chassis 314. This platform/chassis 314 preferably remains substantially stationary during actual digging. More than two photocells could be used to ensure 360 degree coverage in reception of laser light. If used, a third photocell (not shown) could be arranged in a triangular pattern, and would be used to simultaneously measure the cross-axis tilt or roll of the excavator 300. This technique could then be used instead of providing an inclinometer for measuring machine roll.

The electric mast has the function of moving the receiver assembly 345 up and down with respect to the cab 316 of the excavator 300. However, unlike the servo mast the electric mast typically does not move to track the laser beam during machine operation.

The receiver photocells 340 and 342 are preferably mounted parallel to each other and spaced apart by about twenty-six inches (26"=66.0 cm), which is indicated by the dimension "s" (for "spacing") on FIG. 5. The laser receiver photocells 340 and 342 are preferably mounted into a common housing of the receiver assembly 345.

The angle between the horizontal and a line connecting pivot points 324 and 334 is designated as "θ1". The angle between the line connecting pivot points 324 and 334 and a line connecting pivot points 334 and 336 is designated as "θ2". Finally, the angle between a line connecting pivot points 334 and 336 and a bucket position line (which is a line connecting pivot point 336 and a point 338 of the bucket assembly) is designated as "θ3". Rotation (or "angle") sensors are installed at each of the three pivot joints (i.e., at pivot points 324, 334, and 336) in order to determine the elevation of the bucket teeth at all positions of the arms (i.e., boom 320 and dipperstick 330) of excavator 300. The rotational sensors could be either optical encoders or RVDT's (or a combination of both).

Two important planes are depicted on FIG. 5. The first plane, corresponding to a line having the reference numeral 302, is that formed by the rotating laser light emitted by a rotating laser light transmitter (not shown), and which is not level in the case illustrated on FIG. 5, but is somewhat sloped. The second plane, designated by the reference numeral 304, is that formed by the movement of the pivot point 336 when the bucket 332 digs in a desired direction, which on FIG. 5 corresponds to a line that is sloped with respect to the horizontal, and which is parallel to the line (on FIG. 5) that corresponds to the plane 302.

The configuration of excavator 300 provides a full range of machine operation for the customer. In operation, the electric mast 350 is used to position the center of the receiver assembly 345 to the center of the laser beam. During digging, the electric mast would typically not move, and so a "simple" and slow moving mast could be used. The only time that the electric mast is required to move would be when the platform (i.e., the excavator 300 itself) was moved about on the job site.

Another advantage of the system of excavator 300 is that it is omnidirectional. Other systems may sometimes have trouble with receiver position and the reception angle of the receivers. This problem can occur in other systems because the laser receiver is mounted on the side of the dipperstick and is therefore hidden from view of the laser beam if the laser transmitter is on the other side of the dipperstick. This is not the case with the system of excavator 300, since the laser receiver assembly 345 is mounted above the cab 316 or any other obstruction on the machine 300, and the receivers can be configured to be omnidirectional in reception angle. This allows the operator complete freedom of operation of the excavator 300 without regard to digging depth or transmitter position.

The linear distance, along a vertical line, between the bottom edge of laser receiver photocell 340 and the point where photocell 340 is impacted by the laser light of plane 302 is designated as "P1". The linear distance, along a vertical line, between the bottom edge of laser receiver photocell 342 and the point where photocell 342 is impacted by the laser light of plane 302 is designated as "P2". The linear distance, along a vertical line, between the bottom edge of photocell 340 (and photocell 342 at this angle) and the pivot point 324 is designated as "L0". The linear distance, along an angled line, between pivot points 324 and 334 is designated as "L1," and the linear distance, along an angled line, between pivot points 334 and 336 is designated as "L2."

Given these variables, the general equation for the elevation of the bucket joint with respect to the laser plane is given as follows:

EQUATION #3:

$$elev = L0 + \frac{P1 + P2}{2} + \left(\frac{P2 - P1}{s}\right) \cdot (L1\cos\theta 1 + L2\sin(\theta 1 + \theta 2 - 90)) - (L1\sin\theta 1 - L2\cos(\theta 1 + \theta 2 - 90)$$

Assuming a receiver measurement accuracy of ±0.01" (0.25 mm) and a combined boom/dipperstick length of 33' (10.1 m), then in order to meet a system accuracy of ±0.05' (1.5 cm), the target for receiver spacing is about 26" (66 cm), and the required rotational encoder accuracy is about ±0.032 degrees or 1.91 arcmin. The length of the laser receiver's photocells is about 18" (45.7 cm) each in order to accommodate a 50% slope embankment and to allow for pitching and rolling of the machine.

The user interface for the excavator 300 is preferably somewhat more complex so as to allow for initial machine installation and calibration as well as daily elevation setup. Other features could also be included, such as elevation offsets and audible indication as related above in connection with the other excavator systems.

Figure 6:
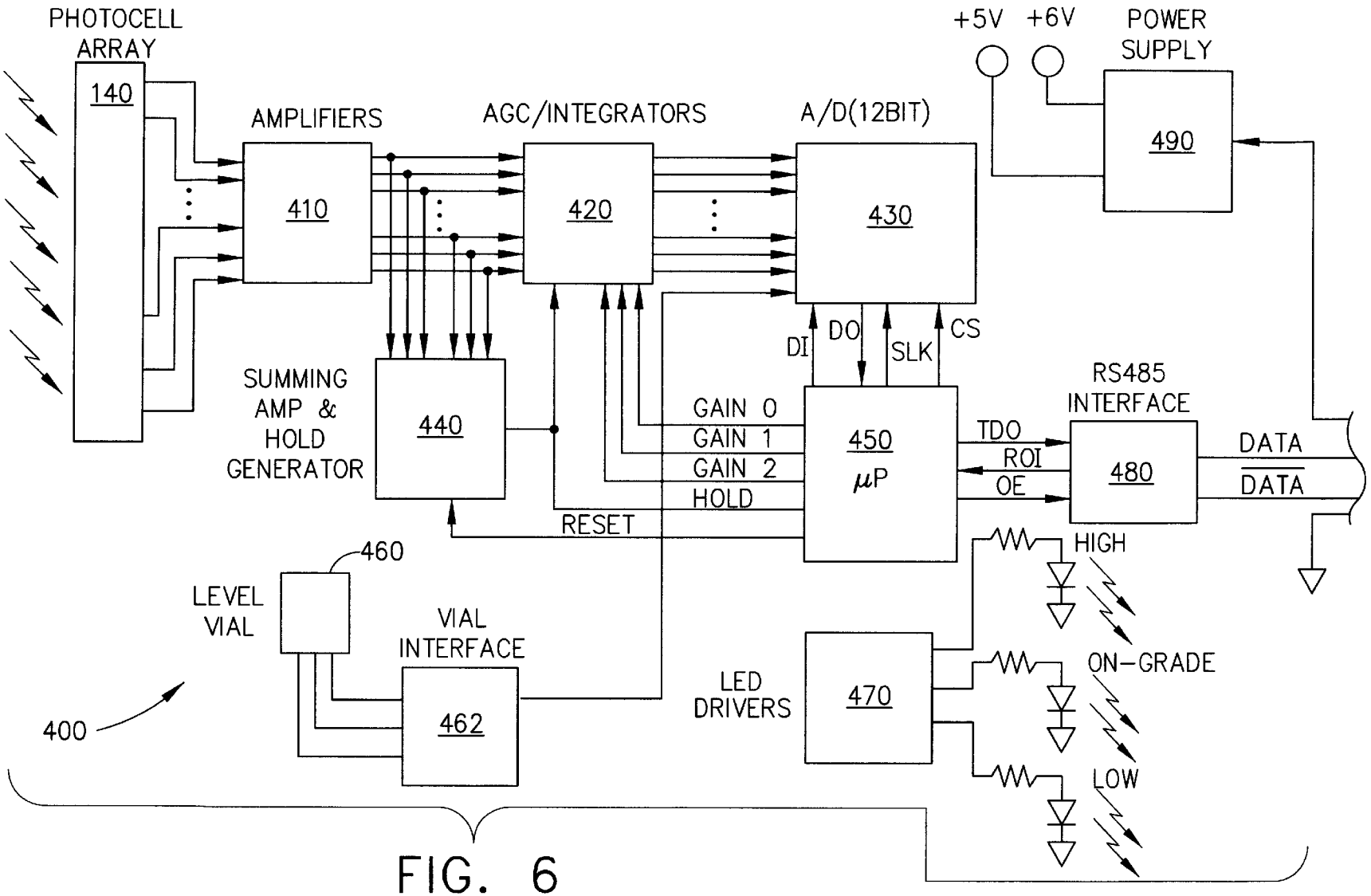
FIG. 6 is a block diagram of the major electronic components used in a laser receiver used in the excavator of FIG. 2.

FIG. 6 illustrates an electrical block diagram 400 of a preferred laser receiver for use with the excavator 100 described hereinabove. Excavator 100 was a "static" system, and the electronics used for the more advanced excavators 200, 250, and 300 described herein would not only include the components depicted on FIG. 6, but would also include further inputs from angle sensors or inclinometers, etc.

Photocell 140 preferably comprises an array of individual photocells, each sensitive to laser light of the same wavelength being emitted by the rotating laser light transmitter. A preferred photocell array is disclosed in U.S. patent application Ser. No. 09/192,770, filed on Nov. 16, 1998, which is commonly owned by Apache Technologies, Incorporated of Dayton Ohio. The output signals of photocell array are provided to a low-noise amplifier input stage at 410. An exemplary low-noise laser input amplifier and receiver is described in U.S. Pat. No. 5,343,033 (by Cain), which is commonly owned by Apache Technologies, Incorporated of Dayton Ohio, and is incorporated by reference herein in its entirety. A related patent is U.S. Pat. No. 5,471,049.

Other components of a preferred laser input amplifier and receiver are illustrated on FIG. 6, and include a set of automatic gain controlled pulse integrators at 420, a multiple-input analog-to-digital converter at 430, a combination multiple-input summing amplifier/comparator/hold generator at 440, and a microprocessor at 450. The description of operation of these components is found in U.S. Pat. No. 5,343,033, as noted above.

A level vial 460 is provided as an input sensing device, and its signal is connected to a vial interface circuit 462, which preferably comprises a bridge interface and an AC voltage supply for the bridge.

A set of LED drivers is provided at 470 to illuminate a set of LED's that are visible by the operator in the cab 116. In the preferred embodiment, a minimum of three different LED's are used, for "High," "On-grade," and "Low" indications.

Microprocessor 450 preferably provides a serial data link to the excavator's control system (not shown) via an RS485 interface at 480. The signal lines are depicted on FIG. 6 as "DATA" and NOT-"DATA."

A power supply 490 is included to provide regulated DC power supply voltages for the electronic components of the preferred laser receiver. A DC voltage from the excavator's cab is used as the source of power to this laser receiver.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

What is claimed is:

1. A level sensing system comprising: (a) a digging machine having a chassis, a pivotable boom, a pivotable dipperstick, and a pivotable bucket; wherein said boom pivots with respect to the chassis at a first pivot joint, said dipperstick pivots with respect to the boom at a second pivot joint, and said bucket pivots with respect to the dipperstick at a third pivot joint; (b) a first light receiving sensor and a second light receiving sensor both mounted to said dipperstick, each of said first and second light receiving sensors providing an indication as to a location of a moving beam of light impacting upon each of said first and second light receiving sensors, said impacting location for both said first and second light receiving sensors being indicative of a pathway of said moving beam of light, thereby providing both distance information and angular information between the pathway of said moving beam of light and an elevation of said third pivot joint, wherein both said distance and angular information are determined without any additional sensor inputs.

2. The level sensing system as recited in claim 1, wherein said first and second light receiving sensors are oriented so as to be substantially parallel to one another.

3. The level sensing system as recited in claim 1, wherein said moving beam of light comprises a sweeping laser light beam generated by a rotating laser light transmitter, said first and second light receiving sensors each comprise an elongated photocell structure responsive to laser light, said distance information comprises an actual distance between the elevation of said third pivot joint and said pathway of said moving beam of light, and said angular information comprises an angle between the elevation of said third pivot joint and a longitudinal centerline between said first and second light receiving sensors.

4. The level sensing system as recited in claim 3, further comprising: at least one angle-measuring sensor for measuring an angular orientation between said substantially stationary portion of said digging machine and a cutting edge of a movable portion of said digging machine.

5. The level sensing system as recited in claim 4, wherein said digging machine comprises an excavator, and wherein said at least one angle-measuring sensor comprises: (a) an angle-measuring sensor that measures an angle between a cab and a boom of said excavator, (b) an angle-measuring sensor that measures an angle between said boom and a dipperstick of said excavator, and (c) an angle-measuring sensor that measures an angle between said dipperstick and a bucket of said excavator.

6. The level sensing system as recited in claim 3, further comprising: at least one angle-measuring sensor for measuring an angular orientation between vertical and a cutting edge of a movable portion of said digging machine; and wherein said digging machine comprises an excavator, and wherein said at least one angle-measuring sensor comprises an inclinometer.

7. A level sensing system for use on a digging machine, said system comprising: a first light receiving sensor and a second light receiving sensor, each of said first and second light receiving sensors providing an indication as to a location of a moving beam of light impacting upon each of said first and second light receiving sensors, said impacting location for both said first and second light receiving sensors being indicative of a pathway of said moving beam of light, thereby providing both distance information and angular information between the pathway of said moving beam of light and a digging elevation, wherein said first and second light receiving sensors are oriented so as to be substantially parallel to one another, and wherein said moving beam of light comprises a sweeping laser light beam generated by a rotating laser light transmitter, said first and second light receiving sensors each comprise an elongated photocell structure responsive to laser light, said digging elevation comprises a desired digging path, said distance information comprises an actual distance between said digging elevation and said pathway of said moving beam of light, and said angular information comprises an angle between vertical and a longitudinal centerline between said first and second light receiving sensors.

8. The level sensing system as recited in claim 7, wherein said digging path is horizontal.

9. The level sensing system as recited in claim 7, wherein said digging path is sloped with respect to the horizontal.

10. The level sensing system as recited in claim 7, wherein said first and second light receiving sensors are mounted on a dipperstick of an excavator, and further comprising: (a) a bucket pivotally mounted at one end of said dipperstick, said bucket including a digging surface which creates said digging path, and (b) an angle-measuring sensor responsive to an angle between said dipperstick and said bucket.

11. The level sensing system as recited in claim 7, wherein said first and second light receiving sensors are mounted on a dipperstick of an excavator, and further comprising: (a) a bucket pivotally mounted at one end of said dipperstick, said bucket including a digging surface which creates said digging path, and (b) an angle-measuring sensor responsive to an angle between said bucket. and vertical.

12. The level sensing system as recited in claim 11, wherein said angle-measuring sensor comprises an inclinometer.

13. The level sensing system as recited in claim 7, wherein said level sensing system operates in a dynamic mode.

14. The level sensing system as recited in claim 7, wherein said first and second light receiving sensors are mounted on a dipperstick of an excavator; and further comprising: a mounting assembly that is movable along said dipperstick, wherein said first and second light receiving sensors are directly. mounted to said movable mounting assembly.

15. The level sensing system as recited in claim 14, wherein said mounting assembly is movable along said longitudinal centerline between said first and second light receiving sensors.

16. The level sensing system as recited in claim 7, wherein said first and second light receiving sensors are mounted on a substantially stationary portion of said digging machine.

17. A level sensing system for use on a digging machine, said system comprising: a first light receiving sensor and a second light receiving sensor, each of said first and second light receiving sensors providing an indication as to a location of a moving beam of light impacting upon each of said first and second light receiving sensors, said impacting location for both said first and second light receiving sensors being indicative of a pathway of said moving beam of light, thereby providing both distance information and angular information between the pathway of said moving beam of light and a digging elevation, and a mounting assembly that is movable along a mast, wherein said first and second light receiving sensors are directly mounted to said movable mounting assembly;

wherein said moving beam of light comprises a sweeping laser light beam generated by a rotating laser light transmitter, said first and second light receiving sensors each comprise an elongated photocell structure responsive to laser light, said digging elevation comprises a desired digging path, said distance information comprises an actual distance between said digging elevation and said pathway of said moving beam of light, and said angular information comprises an angle between said digging elevation and a longitudinal centerline between said first and second light receiving sensors; and wherein both said distance and angular information are determined without any additional sensor inputs.

18. The level sensing system as recited in claim 17, wherein said digging path is horizontal.

19. The level sensing system as recited in claim 17, wherein said digging path is sloped with respect to the horizontal.

20. The level sensing system as recited in claim 17, wherein said mounting assembly is movable along said longitudinal centerline between said first and second light receiving sensors.

21. A level sensing system for use on an excavator, said system comprising: a dipperstick; a light receiving sensor which provides an indication as to a location of a moving beam of light impacting upon the light receiving sensor; and an angle-measuring sensor which provides an indication of an orientation of said dipperstick with respect to a known gravity reference;

wherein said light receiving and angle-measuring sensors provide both distance information and angular information between said pathway of said moving beam of light and a digging elevation; and wherein said moving beam of light comprises a sweeping laser light beam generated by a rotating laser light transmitter, said light receiving sensor comprises an elongated photocell structure responsive to laser light, said digging elevation comprises a desired digging path, said distance information comprises an actual distance between said digging elevation and said pathway of said moving beam of light, and said angular information comprises an angle between vertical and a longitudinal centerline of said dipperstick.

22. The level sensing system as recited in claim 21, further comprising: (a) a bucket pivotally mounted at one end of said dipperstick, said bucket including a digging surface which creates said digging path, and (b) a second angle-measuring sensor responsive to an angle between said dipperstick and said bucket.

23. The level sensing system as recited in claim 22, wherein said second angle-measuring sensor comprises a rotational sensor.

24. The level sensing system as recited in claim 23, wherein said a rotational sensor comprises an optical encoder.

25. The level sensing system as recited in claim 23, wherein said a rotational sensor comprises a rotational variable differential transformer.

26. The level sensing system as recited in claim 22, wherein said second angle-measuring sensor comprises an inclinometer.

27. The level sensing system as recited in claim 21, further comprising: (a) a bucket pivotally mounted at one end of said dipperstick, said bucket including a digging surface which creates said digging path; and (b) a second angle-measuring sensor responsive to an angle between said bucket and vertical.

* * * * *